United States Patent [19]

O'Brien

[11] Patent Number: 4,501,886

[45] Date of Patent: Feb. 26, 1985

[54] CELLULOSIC FIBERS FROM ANISOTROPIC SOLUTIONS

[75] Inventor: John P. O'Brien, Wilmington, Del.

[73] Assignee: E. I. Du Pont de Nemours and Company, Wilmington, Del.

[21] Appl. No.: 519,100

[22] Filed: Aug. 1, 1983

Related U.S. Application Data

[63] Continuation-in-part of Ser. No. 406,533, Aug. 9, 1982, Pat. No. 4,464,323.

[51] Int. Cl.[3] ..... C08B 3/06; C08B 3/20

[52] U.S. Cl. ..... 536/57; 536/69; 536/76; 536/82

[58] Field of Search ..... 536/69, 57, 76, 82

[56] References Cited

U.S. PATENT DOCUMENTS

| | | | |
|---|---|---|---|
| 2,103,012 | 12/1937 | Müller et al. | 536/82 |
| 3,846,404 | 11/1974 | Nichols | 536/76 |
| 3,875,141 | 4/1975 | Drisch | 536/69 |
| 4,357,389 | 11/1982 | Satoh et al. | 428/373 |
| 4,370,168 | 1/1983 | Kamide et al. | 106/177 |

FOREIGN PATENT DOCUMENTS

| | | |
|---|---|---|
| 2340344 | 2/1977 | France . |
| 763489 | 7/1978 | U.S.S.R. . |

OTHER PUBLICATIONS

Journal of Polymer Science, vol. 19, pp. 1449–1460, (1981), and vol. 20, pp. 1019–1028, (1982).

Kirk-Othmer, Encycl. of Chem. Tech., vol. 5, 3rd Ed., pp. 89–117.

*Primary Examiner*—Ronald W. Griffin

[57] ABSTRACT

High strength, high modulus cellulose triacetate fibers are produced by spinning a 30–42% by weight solution of cellulose triacetate having an acetyl content of at least 42.5% and an inherent viscosity of at least 5 from a solvent mixture comprising trifluoroacetic acid and another solvent having a molecular weight of less than 160 in a mol ratio of 0.3–3.0 through an air gap into a coagulating bath. The fibers are optionally heat treated under tension or saponified to provide high strength high modulus regenerated cellulose fibers.

6 Claims, 4 Drawing Figures

CELLULOSIC FIBERS FROM ANISOTROPIC SOLUTIONS

CROSS-REFERENCE TO RELATED APPLICATION

This application is a continuation-in-part of my copending Application Ser. No. 406,533, filed Aug. 9, 1982, now U.S. Pat. No. 4,464,323, issued Aug. 7, 1984.

This invention concerns a new cellulose triacetate fiber, a new regenerated cellulose fiber, and methods for making these fibers from optically anisotropic solutions of cellulose triacetate.

BACKGROUND OF THE INVENTION

Anisotropic spinning solutions from aromatic polyamides have been described in Kwolek U.S. Pat. No. 3,671,542 and in U.S. Pat. No. Re. 30,352. These solutions (dopes) are useful in making aramid fibers of very high tenacity and modulus.

More recently optically anisotropic solutions of cellulosic materials have been described in French Pat. No. 2,340,344, and these too have provided high tenacity/-high modulus fibers. The ever-increasing costs of petrochemicals gives increasing impetus to the study of fibers from renewable sources, such as the cellulosics. In particular cellulosic fibers with properties approaching the aramid properties have been sought. Considerable effort has been applied to the use of optically anisotropic solutions to obtain the desired properties, but heretofore this effort has not been successful in providing cellulosic fiber property levels beyond about 6.8 dN/tex tenacity for cellulose triacetate or about 9.6 dN/tex tenacity for regenerated cellulose, both as described in Example 6 of French Pat. No. 2,340,344.

In the cellulose textile field it has been proposed that higher DP (degree of polymerization) should provide improved properties in the resulting fibers or films but it has not been possible to accomplish this goal because of the extremely high viscosity of the solutions. Anisotropic solutions provide the opportunity for spinning at high concentrations without excessive viscosities, but prior to the present invention adequate solvents for forming high concentration solutions of high DP cellulose triacetate have not been available.

SUMMARY OF THE INVENTION

The invention provides as-spun cellulose triacetate fibers having at least 42.5% by weight acetyl groups, a tenacity of at least 10 dN/tex, an orientation angle (OA) of 35° or less, an inherent viscosity of at least 5, preferably at least 6.3, an AACS value of at least 130 and an exotherm in their DSC scan between 190° and 240° C.

The invention further includes the above cellulose triacetate fibers which have been heat-treated in steam under tension and which have an orientation angle of 20° or less, a tenacity of at least 10.6 dN/tex, and a modulus of at least 155 dN/tex. The invention also provides a regenerated cellulose fiber having an orientation angle of 18° or less, a tenacity of at least 12.4 dN/tex, and a modulus of at least 220 dN/tex. The regenerated cellulose fibers are optionally heat treated to provide an orientation angle of 10° or less.

The process of the invention provides a high strength cellulose triacetate fiber by air-gap spinning an optically anisotropic solution comprising (1) 30 to 42% by weight of cellulose triacetate having an inherent viscosity in hexafluoroisopropanol at 0.5 g/dL of at least 5 and a degree of substitution equivalent to at least 42.5% by weight acetyl groups and (2) 58 to 70% by weight of a solvent mixture comprised of an organic acid having a $pK_a$ of less than 3.5, preferably, less than 1.0, and another solvent having a molecular weight less than 160, the molar ratio of the organic acid to the other solvent being from 0.3 to 3.0, preferably 1.0 to 2.5, the anisotropic solution being spun through an inert non-coagulating fluid layer into a bath comprising a one-to-three-carbon alcohol or diol, preferably methanol, the coagulated yarn from the bath being washed in water to extract remaining solvent and then dried. Preferably the organic acid is trifluoroacetic acid (TFA). Optionally the extracted yarn is heat-treated by stretching 1 to 10% in steam, thereby providing a yarn of higher modulus.

Another aspect of the invention concerns saponification of the as spun high tenacity cellulose triacetate yarn and optionally, heat treating under tension to provide a regenerated cellulose yarn with tenacity of at least 12.4 dN/tex and modulus above 220 dN/tex.

The fibers are useful in ropes and cordage, tire cords and other uses requiring high tensile strength and high modulus.

THE DRAWINGS

Figure 1:
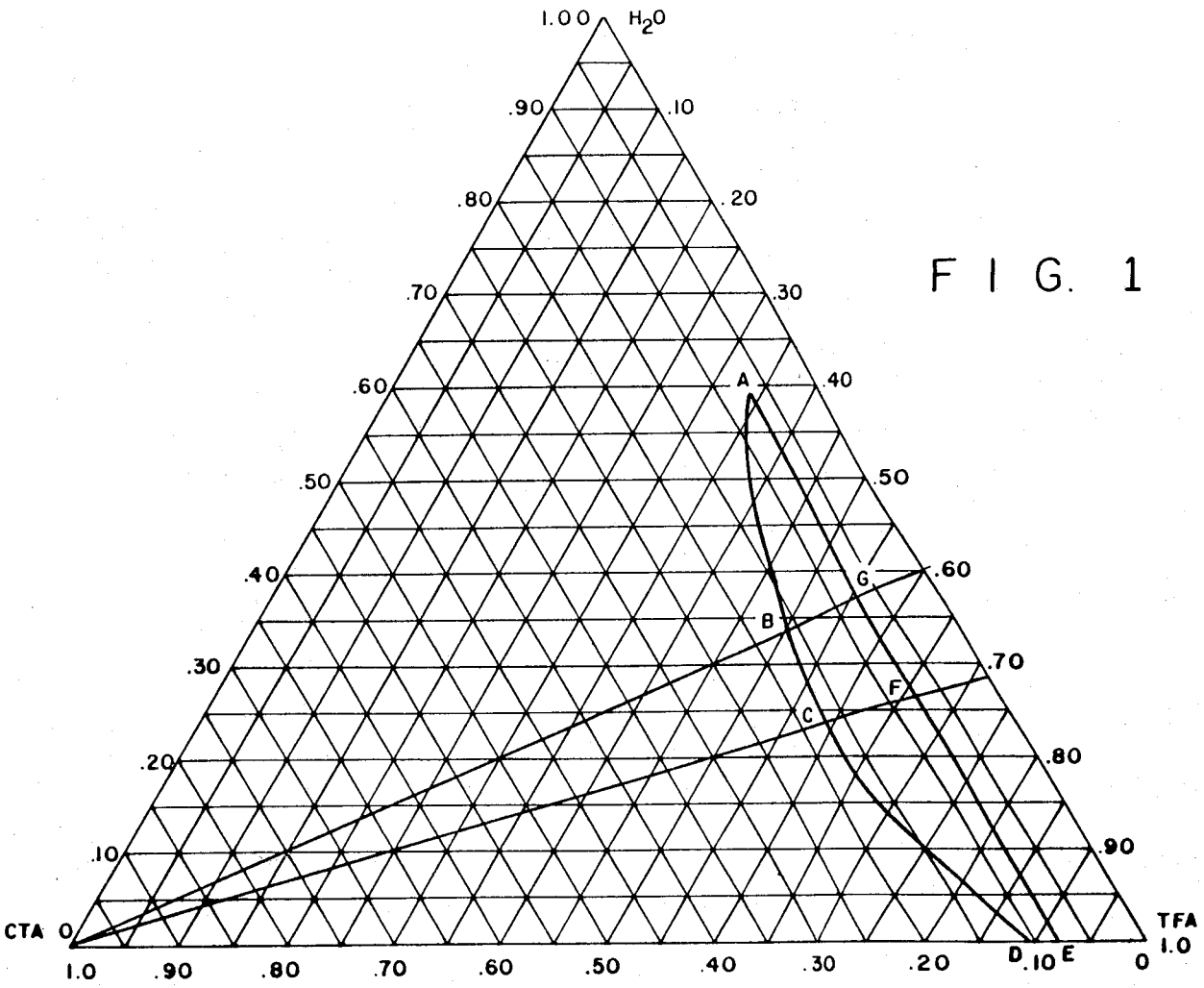
FIGS. 1, 2 and 3 are ternary phase diagrams constructed for the systems comprising cellulose triacetate/trifluoroacetic acid/water, cellulose triacetate/trifluoroacetic acid/methylene chloride and cellulose triacetate/trifluoroacetic acid/formic acid.

Inherent viscosity, $\eta inh = (\ln \eta rel)/C$ where C is the polymer concentration in g. polymer per deciliter solvent. The relative viscosity ($\eta_{rel}$) is determined by measuring the flow time in seconds using a standard viscosimeter of a solution of 0.5 g of the polymer in 100 ml. hexafluoroisopropanol at 30° C. and dividing by the flow time in seconds for the pure solvent. The units of inherent viscosity are dL/g.

Acetyl content of cellulose acetate is determined by ASTM method D-871-72 (reapproved 1978) Method B.

Filament tensile properties were measured using a recording stress-strain analyzer at 70° F. (21.1° C.) and 65% relative humidity. Gauge length was 1.0 in (2.54 cm), and rate of elongation was 10%/min. Results are reported as T/E/M in dN/tex units, T is break tenacity in dN/tex, E is elongation-at-break expressed as the percentage by which initial length increased, and M is initial tensile modulus in dN/tex. Average tensile properties for three to five filament samples are reported. The test is further described in ASTM D2101 part 33, 1980.

The tex of a single filament is calculated from its fundamental resonant frequency, determined by vibrating a 7 to 9 cm. length of fiber under tension with changing frequency. (A.S.T.M. D1577-66, part 25, 1968) This filament is then used for 1 break.

Orientation Angle (OA)

A wide angle X-ray diffraction pattern (transmission pattern) of the fiber is obtained using a Warhus pinhole camera (0.635 mm pinhole diameter) with a sample-to-film distance of 5 cm.; a vacuum is created in the camera during the exposure. A Philips X-ray generator with a copper fine-focus diffraction tube and a nickel betafilter is used, operated at 40 kv and 40 ma. The fiber sample consists of a bundle approximately 0.5 mm thick; all the filaments in the X-ray beam are kept essentially parallel. The diffraction pattern is recorded on Kodak No-Screen medical X-ray film (NS-54T) or equivalent. The film is exposed for a sufficient time to obtain a pattern in which the diffraction spot to be measured has a sufficient photographic density, e.g., between 0.4 and 1.0, to be accurately readable.

The arc length in degrees at the half-maximum density (angle subtending points of 50 percent of maximum density) of the strong equatorial spot at about 8° of $2\theta$ is measured and taken as the orientation angle (OA) of the sample. The measurement is performed by a densitometer method.

The densitometer method used was that described by Owens and Statton in *Acta Cryst.*, 10, p. 560–562 (1957) modified as described in Kwolek U.S. Pat. No. 3,671,542 column 22 line 56 to column 23, line 15.

MEASUREMENT OF APPARENT AXIAL CRYSTALLITE SIZE (AACS)

AACS is obtained from the meridional X-ray profile of the fiber. An automatic 2 theta diffractometer, manufactured by Philips Electronic Instruments, is used in the transmission mode with single crystal monochromatized $CuK_\alpha$ radiation. The generator is operated at 40 kV and 40 mA. The diffractometer is equipped with 1 degree divergence and receiving slits.

About 2 meters of fibers are wound on a specimen holder so that all the filaments are parallel to each other. The thickness of the layer so obtained does not exceed 0.5 mm.

The diffracted intensity is digitally recorded between approximately 14 and 20 degrees of 2 theta by steps of 0.025 degree. The raw intensity data is then corrected for Lorentz and polarization effects (correction factor is $\sin 2\theta/(1+\cos^2 2\theta)$) and smoothed by use of a standard polynomial smoothing routine (see for example J. Steinier et al., Analytical Chemistry, 44, 1906 (1972)).

The resulting profile for fibers of the present invention exhibits a peak at about 17.2 to 17.6 degree of 2 theta. The peak may be asymmetrical because of off-meridional contributions to the profile.

A deconvolution computer routine, similar to those described in the literature (see for example A. M. Hindeleh and D. J. Johnson, Polymer 13, 27 (1972)) is used to resolve the smoothed profile into a baseline and either a single diffraction peak, if the experimental peak is symmetrical or a main peak and a background peak, if not.

The theoretical peaks are calculated as a linear combination of Gaussian and Cauchy profiles. The peak(s) position, height and width at half-height are adjusted for best fit to the experimental profile. The fractions of Gaussian and Cauchy components are fixed and taken as 0.6 and 0.4, respectively for the main peak at about 17.2 to 17.6 degrees of 2 theta, and 0.4 and 0.6, respectively for the background peak (if needed). The base line is initially defined as the straight line joining the intensity points at about 14.3 and 19.1 degrees of 2 theta. It is slightly adjusted in the refinement but kept straight.

The AACS is obtained from the width at half-height, B (radians), of the main peak at about 17.2 to 17.6 degrees of 2 theta as refined by the deconvolution routine:

$$AACS=\lambda/\{\cos\theta(B^2-b^2)^{\frac{1}{2}}\}$$

This is the classical Scherrer equation with a shape factor taken as unity. Other parameters in the equation are:

the wavelength of the X-ray radiation, $\lambda=1.5418$ Å the diffraction angle, $2\theta$, taken as 17.5° the instrumental broadening, b (radians); it is measured as the breadth (at half-height) of the peak at 28.5 degrees of 2 theta of a silicon powder standard provided by the manufacturer.

DIFFERENTIAL SCANNING CALORIMETER (DSC) TEST

A "Du Pont 1090 Thermal Analyzer" differential scanning calorimeter is used, run at 20° C. per minute from room temperature to 400° C. The sample size is about 10 mg. The instrument is calibrated with Indium metal. Heats are directly obtained from the instrument software after selection of a proper baseline for the peak of interest.

As spun fibers of the present invention exhibit a well defined crystallization exotherm at a temperature between 190° C. and 240° C. Heat-treated fibers on the contrary exhibit a flat trace, no peak corresponding to a heat exchange greater than 0.5 Joule/gram being detected.

Activation Procedure

In order to reduce unwanted chain scission, cellulose activation is preferably carried out under mild conditions as shown in Table 1 which permits acetylation at −40° C. to 28° C., providing cellulose triacetate with inherent viscosities above 5.0 from cotton linters, combed cotton or lignin free wood pulp. Although cellulose preactivation was not necessarily required for high temperature acetylation reactions (40°–80° C.) it was found to be essential for success at low temperatures.

In the simplest preactivation process, the cellulose materials (150 g) were boiled in distilled water (4 L) under nitrogen for 1 h. The mixture was allowed to cool to room temperature, the cellulose was collected by suction filtration and pressed out using a rubber diaphragm. It was resuspended in cold water for 15 minutes, isolated again and then immersed in glacial acetic acid (3 L) for 2–3 minutes and pressed out as before. A second glacial acetic acid wash was performed, the acid pressed out, and the damp cotton immediately placed in a prechilled acetylation medium.

Several alternative activation processes are shown in Table 1.

Acetylation Procedure

For the acetylation process a 4 L resin kettle fitted with a Hastelloy C eggbeater type stirrer and a thermocouple was charged with acetic anhydride, 1 L; glacial acetic acid, 690 mL; and methylene chloride; 1020 mL. The reactants were cooled externally to −25° to −30° C. using a solid carbon dioxide/Acetone bath and the pre-activated cellulose (wet with acetic acid) was added. The reactants were then chilled to −40° C. in preparation for catalyst addition.

Acetic anhydride, 450 mL, was chilled to −20° to −30° C. in a 1 L erlenmeyer flask containing a magnetic stirring bar. Perchloric acid (60% aqueous solution, 10 mL) was added dropwise over 5–10 minutes with vigorous stirring while keeping the temperature below −20° C. Because of the strong oxidizing capability of perchloric acid in the presence of organic matter the catalyst solutions should be made and used at low temperature.

The catalyst solution was poured in a steady stream into the vigorously stirring slurry at −40° C. After addition was complete and the catalyst thoroughly dispersed the reactants were allowed to warm to −20° to −25° C. with stirring. At these temperatures the reaction was slow and it was difficult to detect an exotherm. However within 2–6 h the consistency of the slurry changed and the pulp began to swell and break up. After stirring for 4–6 h the reaction vessel was transferred to a freezer at −15° C. and allowed to stand overnight. By morning the reactants had assumed the appearance of a thick, clear gel which on stirring behaved as a typical non-Newtonian fluid (climbed the stirrer shaft). At this time a small sample was precipitated by pouring into methanol (at −20° C.) using a high speed electric blender with a nitrogen purge and then collected by suction filtration. A small portion was blotted to remove excess methanol and checked for solubility in methylene chloride or 100% trifluoroacetic acid. The absence of solution gel particles after 5–10 minutes indicated that reaction was complete and that the bulk polymer was ready for workup. Additionally a portion of the reaction mixture was examined microscopically between crossed polarizers for the possible presence of unreacted fibers which appeared as discrete birefringent domains. If the reaction was not complete the reactants were allowed to stir at −15° to −20° C. and checked every hour for solubility until clear solutions were obtained.

The thick, clear solution was then precipitated batchwise into cold methanol (6 L at −20° C.) using a high speed blender. The highly swollen particles were filtered onto two layers of cheesecloth using suction and pressed out. The resultant mat was then broken up and immersed in acetone (3 L) for a few minutes and then pressed out in order to remove any residual methylene chloride. The white flake was subsequently washed using the following sequence:

4 L 5% Sodium Bicarbonate, once
4 L Water, twice,
3 L Acetone, twice

The product was then placed in shallow pans and allowed to dry in air overnight. Yields were 230–250 g.

Properties of the triacetate polymer are shown in Table I. The process provides cellulose triacetate with at least 42.5% by weight of acetyl groups, preferably at least 44% (theoretical value 44.8%).

TABLE I

| | | ACTIVATION METHOD | REACTION TEMPERATURE (°C.) | $\eta_{inh}$ | % Acetyl |
|---|---|---|---|---|---|
| A | Cotton Linters | Boil 1 hr. in water | −20 to −14 | 6.3 | 44.9 |
| B | Cotton Linters | Boil 2 hrs. in water | −20 to −6 | 7.0 | 42.6 |
| C | Wood Pulp (Floranier F) | Boil 2 hrs. in water | −24 to −15 | 5.9 | 44.4 |
| D | Cotton Linters | Boil 1 hr. in water | −24 to −15 | 6.3 | 44.0 |
| E | Combed Cotton | Extract with ethanol Boil 12 h 1% NaOH Wash, Neutralize 1% acetic acid | −32 to 6 | 6.7 | 45.1 |
| F | Cotton Linters | Boil 1 hour 1% NaOH | −15 to −5 | 6.0 | 43.5 |
| G | Cotton Linters | Soak 3 days in 2.65 L water containing 750 g. urea and 18.2 g. $(NH_4)_2SO_4$ | +19 to +28* | 6.2 | 42.7 |
| H | Wood Pulp (Ultranier J) | Boil 2 hrs. in water | −40 to −25 | 4.8 | 44.0 |

*heterogeneous acetylation

Solution Preparation

Figure 2:
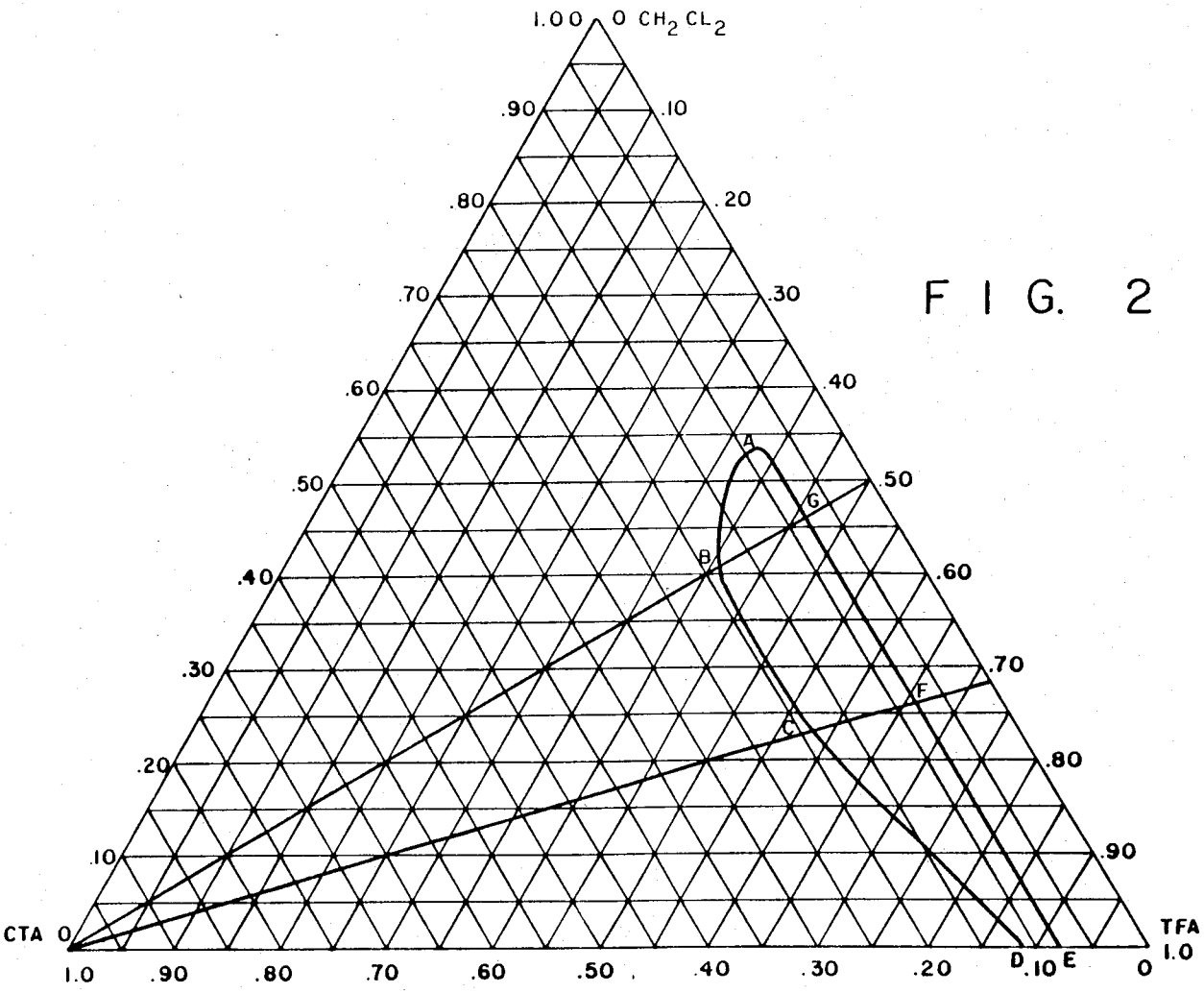
Figure 3:
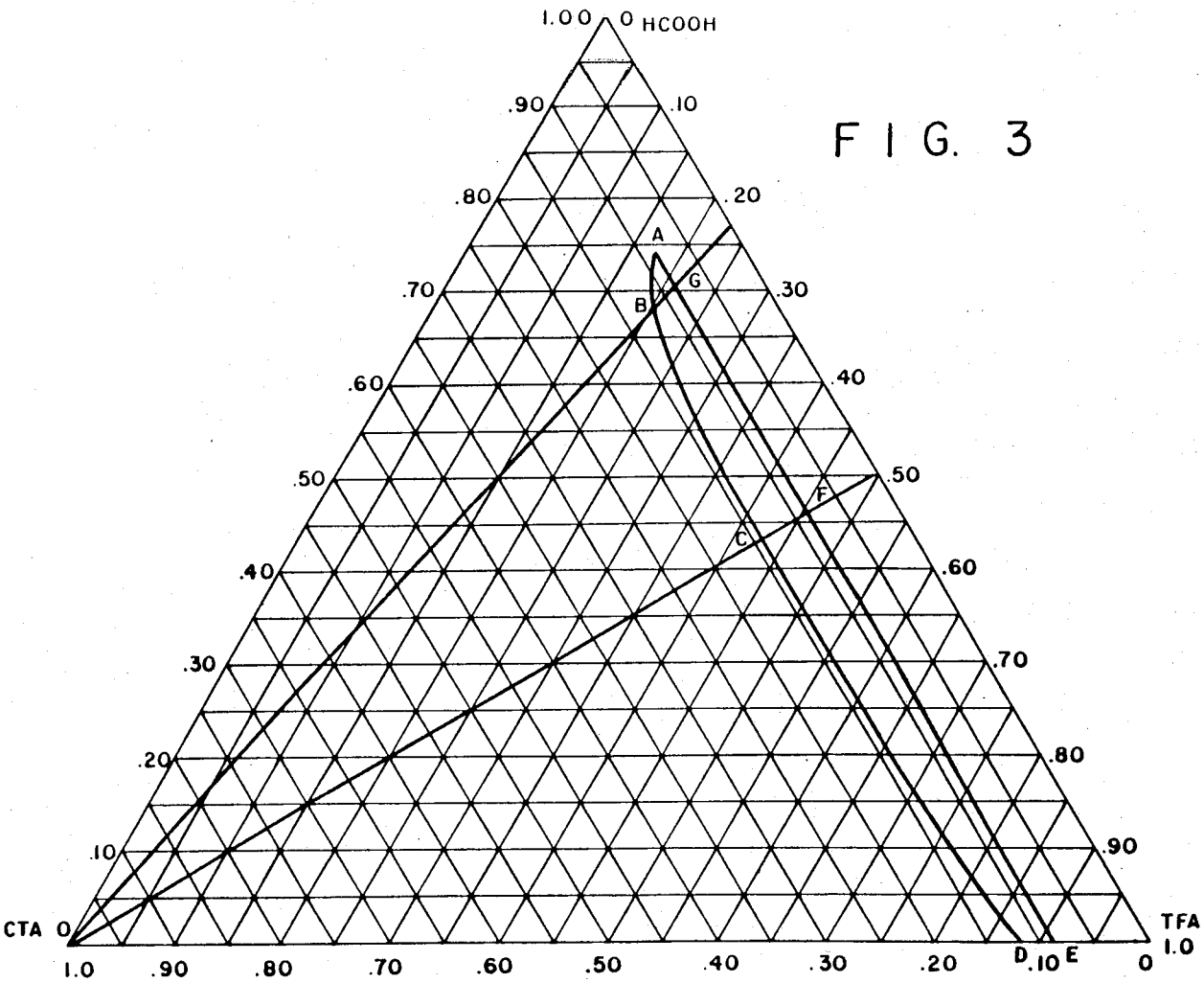

The FIGS. 1, 2, and 3 each show an area wherein optically anisotropic solutions are available with solvent mixtures of certain compositions. The figures further show areas within the anisotropic areas which are capable of providing good spinnability from high solids solutions and which have been found to provide fibers having high tenacity and modulus.

The diagrams were constructed using qualitative observations to determine solubility. The homogeneous solutions were judged anisotropic if samples sandwiched between a microscope slide and cover slip were birefrigent when viewed between crossed polarizers. All observations were taken at room temperature after mixing the solutions and allowing them to stand for 24 hours. A sample was classified as borderline if greater than about 80–90% of the polymer was in solution, but microscopic examination revealed some incompletely dissolved particles. The areas bounded by points ABCDEFG are areas of complete solubility which are anisotropic. The areas BCFG enclose areas of solution composition suitable for use in the present invention. The axes are graduated directly in mole fractions so that for any point on the diagram molar ratios can be determined. Moles of cellulose triacetate are calculated in terms of glucose triacetate repeat units (unit weight=288.25) and labeled on the figures as mole fraction CTA.

It is apparent from FIG. 1 that there is a relatively narrow compositional range over which anisotropic solutions are obtained. In the cellulose triacetate/trifluoroacetic acid/water (CTA/TFA/$H_2O$) system, maximum polymer solubility is achieved at a TFA/$H_2O$ mole ratio of about 2. This corresponds to mole fractions CTA:TFA:$H_2O$ of 0.17:0.55:0.28 or 42 wt. percent CTA based on glucose triacetate repeating units.

In practice optimum spinnability and the desired fiber properties were obtained using 30 to 42% CTA solutions in TFA/$H_2O$ at molar ratios of 1.5–2.5. In the figure, a solvent molar ratio of 1.5 appears as line BG which represents a TFA mole fraction of 0.60 and a solvent molar ratio of 2.5 appears as line CF which represents a TFA mole fraction of 0.714 with respect to the solvent alone.

FIG. 2 is a ternary phase diagram prepared for the system CTA/TFA/$CH_2Cl_2$ using the procedure as previously outlined. As in the CTA/TFA/$H_2O$ system, solubility is significantly enhanced as the glucose triacetate unit:solvent stoichiometry converges on a 0.17:0.83 mol ratio. The optimum spinnability and high tensile properties are obtained at 35 to 42% solids in solutions wherein the molar ratio of TFA/$CH_2Cl_2$ is 1.0 to 2.5 which corresponds to mol fractions of TFA of 0.50 to 0.714 as shown in the figure.

FIG. 3 is the ternary phase diagram prepared for a CTA/TFA/HCOOH system using the procedure as previously outlined. As in the previous example, polymer solubility is significantly enhanced as the polymer:-solvent stoichiometry converges on 0.15:0.85 mol ratio. The figure is constructed using mixtures of TFA in combination with formic acid (98–100% by weight) assuming 100% formic acid. As shown in the figure, formic acid is not a sufficiently good solvent for commercial cellulose triacetate polymer to achieve high solids anisotropic solutions. On the other hand, mixtures of TFA and formic acid at molar ratios of 0.3 to 1.0 are excellent solvents (mole fraction TFA of 0.23 to 0.50). Optimum spinnability and tensile properties are obtained with the stated solvent molar ratios at 35 to 42% solids by weight.

Spinning

Figure 4:
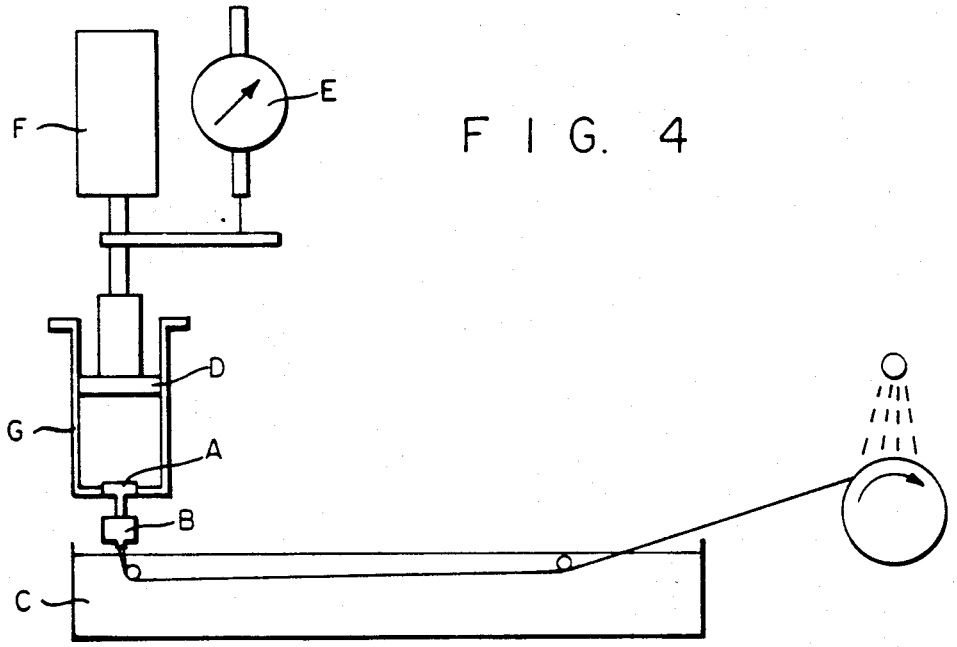
FIG. 4 is a schematic diagram of apparatus for air-gap spinning of anisotropic solutions of cellulose triacetate.

High solids, anisotropic solutions of cellulose triacetate were air-gap-spun into cold methanol using apparatus shown in FIG. 4. A piston (D) activated by hydraulic press (F) and associated with piston travel indicator (E) was positioned over the surface of the dope, excess air expelled from the top of the cell and the cell sealed. The spin cell (G) was fitted at the bottom with the following screens (A) for dope filtration—2X 20 mesh, 2X 100 mesh, 1 "Dynalloy" (X5), 2X 100 mesh and 2X 50 mesh. The filtered dope then passed into a spinneret pack (B) containing and following complement of screens—1X 100 mesh, 2X 325 mesh, 2X 100 mesh and a final 325 mesh screen fitted in the spinneret itself. Dopes were extruded through an air gap at a controlled rate into a static bath (C) using a Zenith metering pump to supply hydraulic pressure at piston D. The partially coagulated yarn was passed around a 9/16" diameter "Alsimag" pin, pulled through the bath, passed under a second pin and wound up. Yarn was washed continuously on the windup bobbin with water, extracted in water overnight to remove residual TFA and subsequently air dried. The spinning parameters are given in Table 2.

Excellent fiber properties were realized with spin bath temperatures in the range of −1° C. to −33° C. and spin-stretch factors between 2.0–7.6 using cellulose triacetate derived from polymers A, B, C, D and E of Table I. Polymer F, which was prepared from cellulose activated in 1% NaOH, gave somewhat poorer properties, but still superior to the properties of prior art cellulose triacetate fibers. Good fiber properties might not be obtained if less than optimum spinning conditions are used. With the equipment used (maximum cell pressure = 800 lbs/in$^2$ (56.2 kg./cm.$^2$) typically attainable jet velocities were in the range of 15–50 ft/min (4.57–15.2 m/min). It was possible to increase jet velocity by localized warming at the spinneret (up to 40° C.). Liquid crystalline solutions may revert to an isotropic state when heated above a certain critical temperature and optimum spinnability and fiber tensile properties are obtained only below this temperature.

Filament tensile properties for as-spun cellulose triacetate are given in Table 3. In general, the filaments exhibit a slight yield at 1–2% elongation under tension after which the curve becomes essentially linear to failure. It should be noted that macroscopic defects in filaments can cause poorer tensile properties to be obtained even when a satisfactory low orientation angle is obtained. Spinning conditions can have an important effect on tensile properties, e.g., tenacity, on a macroscopic scale. The macroscopic effect can be detected by testing filaments at a number of different gauge lengths on the tensile tester.

TABLE 2

| Spin | Polymer | $\eta_{inh}$ | % Solids | Solvent | Solvent mole Ratio | air gap (cm.) | Spinneret Holes no. dia. mm | Bath Temp, °C. | Extrusion Rate m/min | Windup Speed (m/min) |
|---|---|---|---|---|---|---|---|---|---|---|
| 1 | E | 6.7 | 35 | TFA/$CH_2Cl_2$ | 1.25 | 2.54 | 20/.076 | −30 | 1.52 | 7.0 |
| 2 | A | 6.3 | 35 | TFA/$H_2O$ | 1.97 | 2.54 | 40/.076 | −26 | 6.4 | 12.8 |
| 3 | C | 5.9 | 38 | TFA/$H_2O$ | 1.97 | 3.81 | 40/.076 | −33 | 4.27 | 26.0 |
| 4 | B | 7.0 | 35 | TFA/$H_2O$ | 1.97 | 3.81 | 20/0.152 | −1 | 1.6 | 8.4 |
| 5 | D | 6.3 | 38 | TFA/$H_2O$ | 1.97 | 2.54 | 40/.076 | −19 | 3.35 | 10.1 |
| 6 | F | 6.0 | 40 | TFA/$H_2O$ | 1.97 | 2.54 | 20/0.152 | −16 | 1.07 | 8.1 |
| 7 | F | 6.0 | 35 | TFA/$H_2O$ | 1.97 | 2.54 | 40/.076 | −22 | 4.57 | 6.8 |
| 8 | F | 6.0 | 25 | TFA/$H_2O$ | 1.97 | 1.75 | 20/.076 | −20 | 15.2 | 25.8 |
| 9 | F | 6.0 | 20 | TFA/$H_2O$ | 1.97 | 2.54 | 20/.076 | −25 | 26.2 | 16.8 |
| 10 | E | 6.7 | 35 | TFA/$CH_2Cl_2$ | 1.25 | 4.44 | 40/.076 | −20 | 3.1 | 6.2 |
| 11 | C | 5.9 | 38 | TFA/$H_2O$ | 1.97 | 1.91 | 40/.076 | −20 | 4.6 | 6.0 |
| 12 | G | 6.2 | 40 | TFA/$CH_2Cl_2$ | 1.25 | 2.54 | 40/0.076 | −32 | 5.2 | 22.9 |
| 13 | D | 6.3 | 35 | TFA/HCOOH | 1.0 | 2.54 | 40/0.076 | −25 | 4.9 | 11.9 |
| 14 | D | 6.3 | 38 | TFA/$H_2O$ | 1.97 | 2.54 | 40/0.076 | −24 | 4.87 | 12.2 |
| 15 | A | 6.3 | 35 | TFA/$H_2O$ | 1.97 | 2.54 | 40/0.076 | −31 | 3.96 | 9.4 |
| 16 | B | 7.0 | 35 | TFA/$H_2O$ | 1.97 | 3.81 | 20/0.152 | −25 | 0.98 | 8.3 |
| 17 | I* | 3.9 | 23 | TFA/$CH_2Cl_2$ | 15.8 | 1.27 | 20/0.076 | −19 | 16.2 | 35.6 |

*Eastman Cellulose Triacetate No. 2314

TABLE 3

| Spin | Polymer | $\eta_{inh}$ | OA | As Spun T/E/Mi (dN/tex) | AACS (Å) | Spin | Polymer | $\eta_{inh}$ | OA | As Spun T/E/Mi (dN/tex) | AACS (Å) |
|---|---|---|---|---|---|---|---|---|---|---|---|
| 1 | E | 6.7 | 28 | 10.2/6.7/175 | 161 | 10 | E | 6.7 | 28 | 8.9/7.9/148 | 161 |
| 2 | A | 6.3 | 30 | 12.7/9.7/179 | 132 | 11 | C | 5.9 | 30 | 7.7/9.3/128 | 113 |
| 3 | C | 5.9 | 22 | 10.2/8.2/154 | 142 | 12 | G | 6.2 | 22 | 7.3/7.6/147 | 153 |
| 4 | B | 7.0 | 30 | 11.9/11.4/147 | 151 | 13 | D | 6.3 | 32 | 8.2/9.1/124 | 109 |
| 5 | D | 6.3 | 31 | 13.3/10.6/181 | 153 | 14 | D | 6.3 | 28 | 8.2/9.6/106 | — |
| 6 | F | 6.0 | 27 | 8.2/9.5/105 | 151 | 15 | A | 6.3 | 31 | 10.4/10.8/133 | 141 |
| 7 | F | 6.0 | 25 | 7.1/9.0/103 | 123 | 16 | B | 7.0 | 30 | 11.1/8.2/143 | — |

TABLE 3-continued

| Spin | Polymer | $\eta_{inh}$ | OA | As Spun T/E/Mi (dN/tex) | AACS (Å) | Spin | Polymer | $\eta_{inh}$ | OA | As Spun T/E/Mi (dN/tex) | AACS (Å) |
|---|---|---|---|---|---|---|---|---|---|---|---|
| 8 | F | 6.0 | 35 | 5.0/7.7/117 | | −17 | I* | 3.9 | 38 | 5.4/10.8/95 | 97 |
| 9 | F | 6.0 | 45 | 1.6/10.9/96 | <91 | | | | | | |

Heat Treatment of Cellulose Triacetate Fibers

Table 4 shows suitable conditions for heat treating the cellulose triacetate yarn. The cellulose triacetate yarns were spun as shown in Table 2 but in some instances the treated yarns were derived from different bobbins of the spins indicated in Table 2. It should be noted that the yarn is treated under tension. Tension can provide 1–10% stretch in the yarns. Simple annealing in skein form does not provide the high tenacity yarns of the invention, i.e., yarns with tenacity above 10.6 dN/tex. The apparatus for heat treatment consisted of a conventional steam tube capable of saturated steam pressures of up to 7 kg/cm$^2$ between feed and draw rolls. The steam in the treatment chamber was kept at 4.22 to 6.33 kg/cm$^2$ (gauge) ($5.15\times10^5-7.22\times10^5$ Pascals absolute). For heat treatment in superheated steam a modified steam tube fed with superheated rather than saturated steam was used.

TABLE 4

HEAT TREATMENT OF CELLULOSE TRIACETATE AND REGENERATED CELLULOSE IN STEAM

| Spin No. | Rate (m/min) Feed | Rate (m/min) Wind-Up | Draw Ratio | Tension (g) | Tex | Steam Pressure (kg/cm$^2$) (gauge) | Temp. (°C.) | OA After | T/E/Mi (dN/tex) Before | T/E/Mi (dN/tex) After |
|---|---|---|---|---|---|---|---|---|---|---|
| A. CELLULOSE TRIACETATE | | | | | | | | | | |
| 12 | 5.49 | 5.76 | 1.05 | 200 | 20.4 | 4.9 | 158 | 12 | 7.3/7.6/147 | 11.5/5.4/248 |
| 15 | 3.20 | 3.35 | 1.05 | 400 | 33.3 | 0.21 | 255* | 12 | 10.4/10.8/133 | 12.6/6.1/199 |
| 5 | 2.44 | 2.59 | 1.06 | 300 | 32.0 | 5.6 | 162 | 13 | 13.3/10.6/181 | 12.8/6.4/212 |
| 4 | 2.44 | 2.51 | 1.03 | 450 | 46.4 | 5.6 | 162 | 13 | 11.9/11.4/147 | 11.8/6.1/213 |
| B. REGENERATED CELLULOSE | | | | | | | | | | |
| 14 | 0.91 | 0.94 | 1.03 | 500 | 21.8 | 0.2 | 137* | 9 | 10.0/5.2/307 | 15.1/5.9/364 |
| 14 | 1.52 | 1.60 | 1.05 | 175 | 21.8 | 0.2 | 106* | 7 | 10.0/5.2/307 | 15.0/6.9/300 |

*superheated steam

Saponification of Cellulose Triacetate to Cellulose

The triacetate yarns were converted to regenerated cellulose by saponification in sealed containers at room temperature which had been purged with nitrogen before sealing. The saponification medium was 0.05 molar sodium methoxide in methanol. Skeins of yarn were treated at room (RT) or at the temperature shown in Table 5 for several hours. Cellulose triacetate fibers may be advantgeously saponified under tension. Loops of triacetate yarn are hung with lead shot weights in the saponification medium. No correction is made for buoyancy effects. The properties of the cellulose triacetate precursor and the regenerated cellulose filaments are shown in Table 5.

TABLE 5

Tensile Properties of As-Regenerated Cellulose Fibers from Anisotropic Triacetate Precursors

| Spin | Time (h) | Temp. (°C.) | As-Spun T/E/Mi (dN/tex) | As Regenerated T/E/Mi (dN/tex) | As Regenerated OA |
|---|---|---|---|---|---|
| 10 | 93 | RT | 8.9/7.9/148 | 16.4/9.1/301 | 11 |
| 16 | 71 | RT | 11.1/8.2/143 | 14.3/8.4/275 | 12 |
| 2 | 4 | 60 | 12.7/9.7/179 | 13.1/8.4/220 | 12 |
| 11 | 70 | RT | 7.7/9.3/128 | 12.8/8.2/264 | 13 |
| 5 | 18 | 60 | 13.3/10.6/181 | *18.2/6.4/307 | 9 |

*Saponified under a tension of 6.6 g./tex

Heat Treatment of Regenerated Cellulose Yarns

The properties of regenerated cellulose yarns, may be improved by heat treating in steam as shown in Table 4. The filaments reported in Table 4 are from different spins than those reported in Table 5. However it should be noted that both the regeneration step and the subsequent heat treatment are effective in increasing tenacity.

What is claimed is:

1. Cellulose triacetate fibers having at least 42.5% by weight acetyl groups, an inherent viscosity in hexafluoroisopropanol at 0.5 g/dl of at least 5, a tenacity of at least 10 dN/tex, an orientation angle of 35° or less, an AACS value of at least 130 and an exotherm in their DSC scan in the range between 190° and 240° C.

2. The fibers of claim 1 having at least 44% by weight acetyl groups.

3. The fibers of claim 1 having an inherent viscosity in hexafluoroisopropanol at 0.5 g/dl of at least 6.3.

4. Cellulose triacetate fibers having at least 42.5% by weight acetyl groups, an inherent viscosity in hexafluoroisopropanol at 0.5 g/dl of at least 5, a tenacity of at least 10.6 dN/tex, a modulus of at least 155 dN/tex, and an orientation angle of 20° or less.

5. Regenerated cellulose fibers having a tenacity of at least 12.4 dN/tex and a modulus of at least 220 dN/tex, and an orientation angle of 18° or less.

6. Regenerated cellulose fibers of claim 5 having an orientation angle of 10° or less.

* * * * *